United States Patent [19]

Pearson

[11] 4,206,912

[45] Jun. 10, 1980

[54] PAPER SENSING MECHANISM

[75] Inventor: Rune S. Pearson, Torrance, Calif.

[73] Assignee: Joseph Wertheimer, Sarasota, Fla.

[21] Appl. No.: 898,464

[22] Filed: Apr. 20, 1978

[51] Int. Cl.[2] ..... B65H 1/18

[52] U.S. Cl. ..... 271/154; 200/61.2; 200/153T

[58] Field of Search ..... 271/154, 155, 152, 153, 271/156, 130, 31; 200/153 T, 335, 332, 331, 330, 47, 61.2, 61.41, 61.42

[56] References Cited

U.S. PATENT DOCUMENTS

| | | | |
|---|---|---|---|
| 2,431,747 | 12/1947 | Fry | 200/153 T X |
| 3,921,970 | 11/1975 | Stanfield | 271/154 X |
| 4,033,576 | 7/1977 | Stanfield | 271/155 X |

FOREIGN PATENT DOCUMENTS

| | | | |
|---|---|---|---|
| 337953 | 11/1930 | United Kingdom | 200/330 |

*Primary Examiner*—Bruce H. Stoner, Jr.
*Attorney, Agent, or Firm*—Edward J. DaRin

[57] ABSTRACT

A sensing mechanism for commercially available printing machines wherein paper is automatically fed into the machine sheet by sheet. The sensing mechanism is adapted to be mounted to the machine for permitting it to sense the arrival of a stack of paper at a preselected location as the paper feed table is automatically elevated. When the preselected location is sensed, the table elevation is arrested to prevent the prior art paper "overfeeding" problems.

5 Claims, 7 Drawing Figures

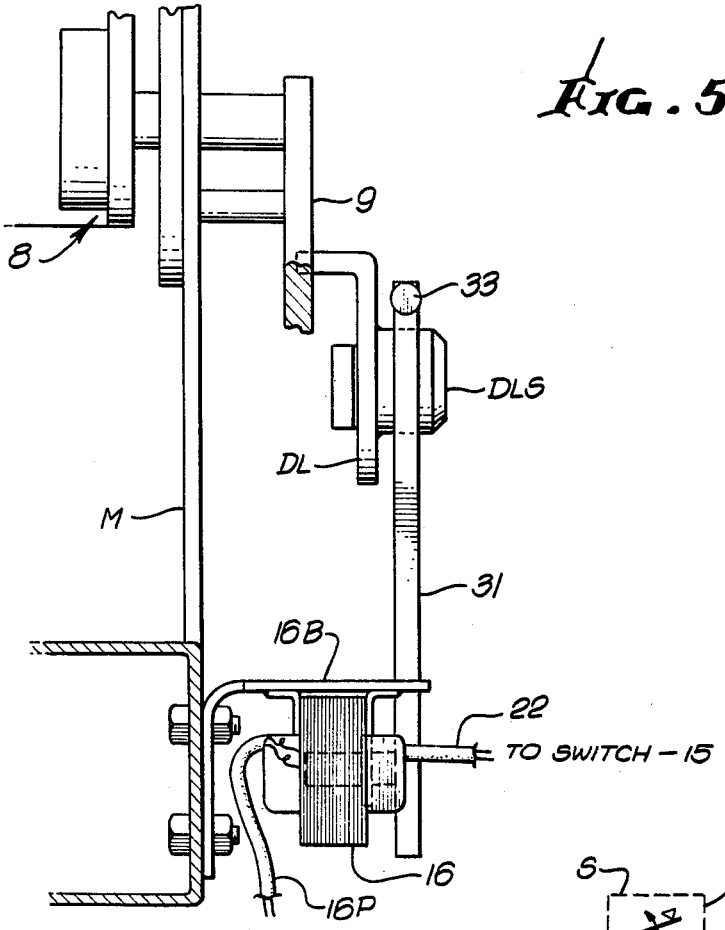
FIG. 5.
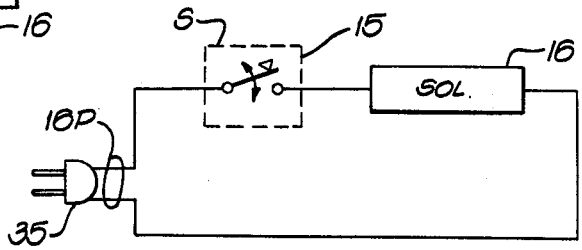
FIG. 7.
FIG. 6.
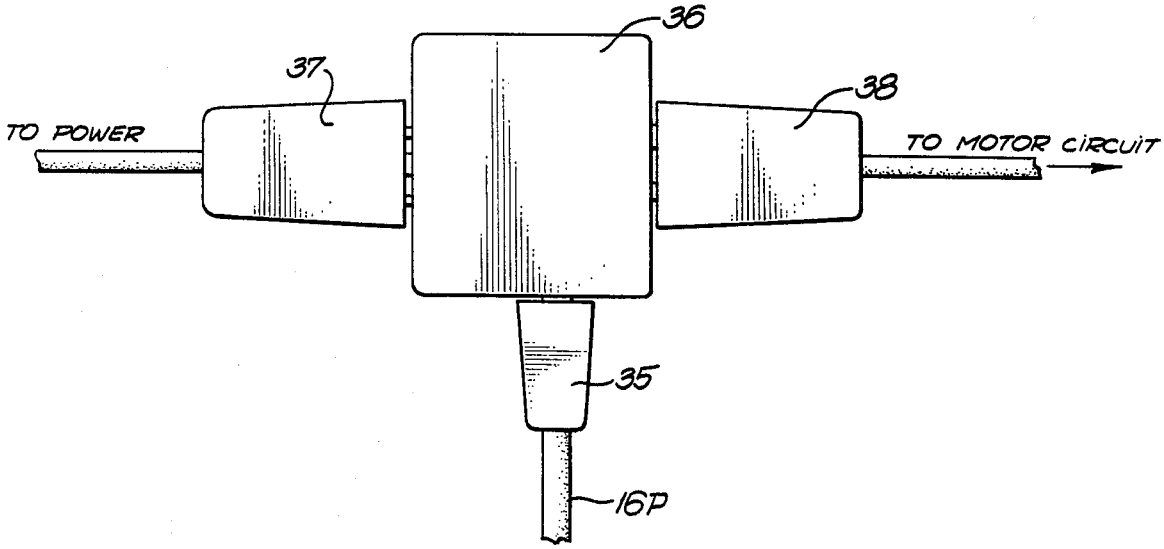

PAPER SENSING MECHANISM

PRIOR ART AND SUMMARY OF THE INVENTION

At the present time there are commercially available printing machines for printing on paper wherein the paper is automatically fed into a machine for printing purposes. The paper to be printed is generally stored on a paper feed table that is automatically operated for elevating the level of the paper for feeding it into the printing mechanism. These prior art machines are defined to automatically maintain the proper feeding level by the action of paper height regulators until the feed table reaches the maximum height. Such machines are sold by the A. B. Dick Company of Chicago, Ill. and are commercially identified as their Model 350-360 printers. The A. B. Dick Company printing machine utilizes four sensing fingers for regulating when the paper feed table should move up and down and when it should stop. The fingers move up and down as the printing machine operates. This sensing system operates in an acceptable fashion for most types of paper. When the paper to be printed is highly compressible, it has been found that these sensing fingers are not sensitive enough, thereby permitting the paper feed table to move upwardly too high before it is stopped. This causes improper operation of the machine and is commonly referred to as "overfeeding". The types of paper that can cause problems in such prior art machines are envelopes, onionskin, curled paper and badly warped envelopes. With such standard sensing fingers, the undesired elevation of the compressible paper allows the paper to compress under the paper height regulator so that the vacuum system normally employed in the machine for feeding the paper into the machine for printing purposes cannot pull out the paper and feed it into the machine.

The present invention provides an improved and relatively inexpensive machine adaptable for sensing the elevation of the paper stored on the paper feed table of commercially available printing machines for eliminating the "overfeed" problem inherent in such prior art machines thereby permitting highly compressible paper stock, such as envelopes, onionskin and the like, to be printed as well as the regular paper stock. The sensing mechanism of the present invention may be readily installed on commercially available printing machines such as the A. B. Dick Model 350-360 in 10 to 15 minutes without the need to remove any covers or fasteners, or to drill any holes or modify the normal operation of the machine. The sensing mechanism is adapted to be adjusted to a vertical position below the sensing position of the conventional machine sensing fingers built into the printer and thereby permitting highly compressible paper stock, including badly warped envelopes and curled paper, to be printed as well as other types of paper. In addition, when it is not desired to use the sensing mechanism of the present invention, it can be simply moved out of contact with the paper stock and the printing machine will operate in its normal mode.

The paper sensing mechanism of the present invention is defined so that the sensing pressure necessary for operating the mechanism is the same without reference to the vertical setting of the mechanism for sensing various heights of the paper stored on the conventional paper feed table. The sensor is further defined to allow for overtravel of the sensing mechanism when it is actuated thereby permitting it to be utilized on a greater number of prior art type machines. Specifically, in the older model printing machines, the paper feed table for the machines travel over twice the distance that is traveled by the new model machines. The provision of such an overtravel feature in the sensing mechanism of the present invention prevents excessive pressure from being exerted against the top of the stack of paper to be printed which could hamper the proper feeding of the paper, as has been experienced with the prior art mechanisms.

From a structural standpoint, the present invention comprehends a sensing mechanism adapted to be connected to a conventional printing machine for sensing and regulating the feeding level of the paper stored on a paper feed table to be supplied to the printing machine. The sensing mechanism includes a housing for an electro-mechanical switch having an operating arm extending outwardly therefrom and mounted in a housing for operating the switch between an electrical conductive and non-conductive condition. The switch actuating member is mounted to be housing for restricted sliding movement and is adapted to engage the switch operating arm for moving the arm between a switch OPEN and switch CLOSED condition to thereby define the conductive and non-conductive conditions of the switch. The switch actuating member includes means secured thereto for sliding movement in unison therewith and arranged to extend outwardly from the one end of the actuating member and the housing for defining a paper pressure sensing member. The weight of the switch actuating member and the sensing member are selected for normally maintaining the switch operating arm in a preselected vertical position and the switch in a corresponding preselected conductive condition. The paper pressure sensing member is adapted to be responsive to a relatively slight pressure exerted against the outer end thereof for movement away from the preselected vertical position to move the switch operating arm and thereby operate the switch to the other electrical conductive condition. Electro-mechanical means are connected in an electrical circuit relationship with the electro-mechanical switch to be energized and de-energized therby. The electro-mechanical means is adapted to be coupled to the actuatable link means for the printing machine for operating the link means to automatically stop the elevation of the machine feed table in response to the operation of the switch to its other electrical conductive condition.

These and other features of the present invention may be more fully appreciated when considered in the light of the following specification and drawings, in which:

FIG. 5 is a cross-sectional view taken along the line 5—5 of FIG. 4;

FIG. 6 is an elevational view of the electrical plugs as arranged for energizing the sensing mechanism of the present invention; and FIG. 7 is a schematic circuit diagram of the electrical arrangement of the sensing switch and electro-mechanical actuator.

Figure 1:
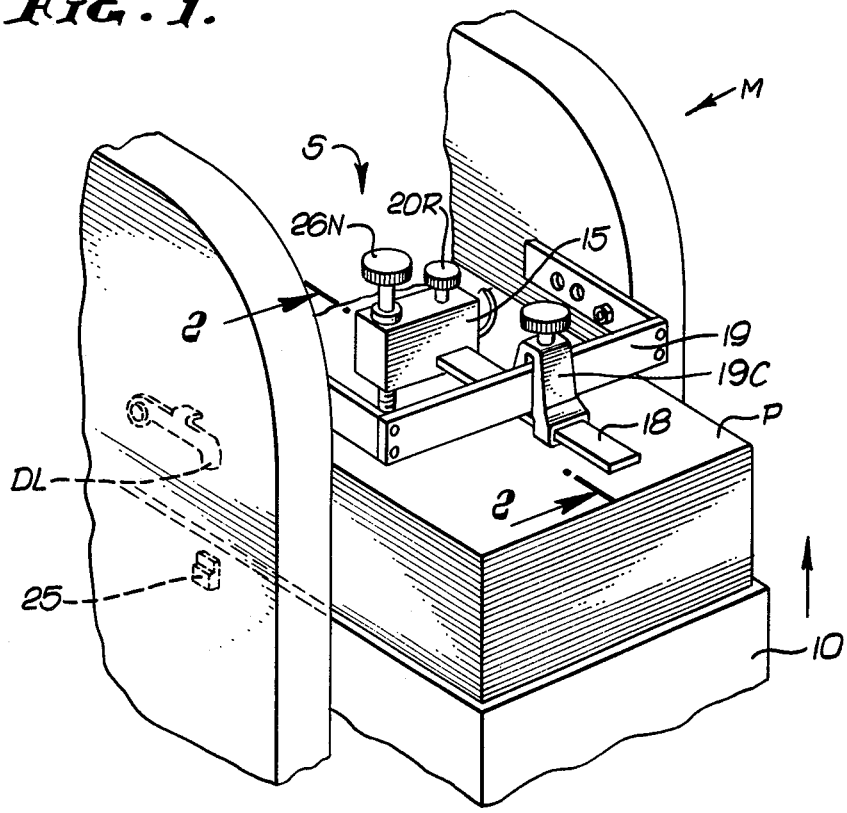
FIG. 1 is a partial, elevational view of the printing machine illustrating the paper sensing mechanism mounted thereto and embodying the present invention.

Now referring to the drawings, the details of the invention will be described as it may be used with commercially available printing machines of the type sold by A. B. Dick Company of Chicago, Ill., and in particular their Model 350-360 printing machines. A detailed description of the conventional operation of the A. B. Dick printing machines will not be included herein as it tends to encumber the understanding of the present invention. A brief description of the table raising mechanism employed in the A. B. Dick machines is deemed sufficient for the purposes of understanding the present invention. If a more detailed description of the table raising mechanism is desired, reference may be had to the A. B. Dick published manuals describing their Model 350-360 machine and which manuals are incorporated herein by reference. It will be understood that the paper to be printed, P, is stacked on the paper feed table 10 which is vertically movable. Briefly, for the purposes of the present invention, it should be understood that once the paper feed table 10 of the printing machine M is adjusted to the paper feeding level, the stack of paper is automatically maintained at the proper feeding level by the action of paper height regulators (not shown) associated with the machine M until the feed table 10 reaches maximum height. As each sheet of paper is fed into the machine M to be printed, the paper height regulators move down lower and lower. The lowering of the paper height regulators of the conventional machine causes certain linkages to be operated for raising the feed table in response to the lowering of the stack of papers. The lowering of the paper height regulators in these prior art machines causes a double lever assembly 9 and a lever 8 to move in a clockwise direction; see FIG. 5. This lever movement actuates the associated mechanism for causing the chains supporting the feed table to raise the feed table to a new vertical paper feeding position. The maximum height of the feed table 10 is reached when a trip bracket 25 normally provided with the machine M contacts and lifts a double lever assembly DL and moves it into the path of the double lever assembly 9. This action stops the paper height regulators from moving fully down and the operating of the associated link assemblies to thereby prevent further elevation of the feed table. This is the normal operation of the mechanism for elevating the feed table in response to the sensing action of the paper height regulators.

The sensing mechanism S of the present invention is arranged to be operable during the travel of the trip bracket 25 towards the double lever assembly DL so as to arrest the elevation of the feed table 10 at a vertical point prior to the time that the trip bracket 25 actually contacts the double lever assembly DL. To this end, the sensing mechanism S is arranged to actuate the double lever assembly DL so as to prevent further elevation of the feed table 10 beyond a preselected elevation and thereby eliminate the conditions producing the paper "overfeeding" problem normally associated with such prior art printing machines.

The sensing mechanism S is adapted to be mounted to the machine M without the need to remove any covers, fasteners or to drill holes or modify the normal operation of the machine. The sensing mechanism S comprises a sensing switch 15 for controlling the actuation of an electro-mechanical element, or solenoid 16. The electro-mechanical element 16 is mounted to the side of the machine M and is coupled to the double linkage assembly DL normally provided for the machine M for elevating the linkage assembly DL to cause it to actuate the associated levers 8 and 9 and the remaining machine elements for arresting the elevation of the feed table 10. The solenoid 6 is mounted on a bracket 16B which is secured to the end of the fasteners provided for the machine M; see FIGS. 4 and 5.

Figure 2:
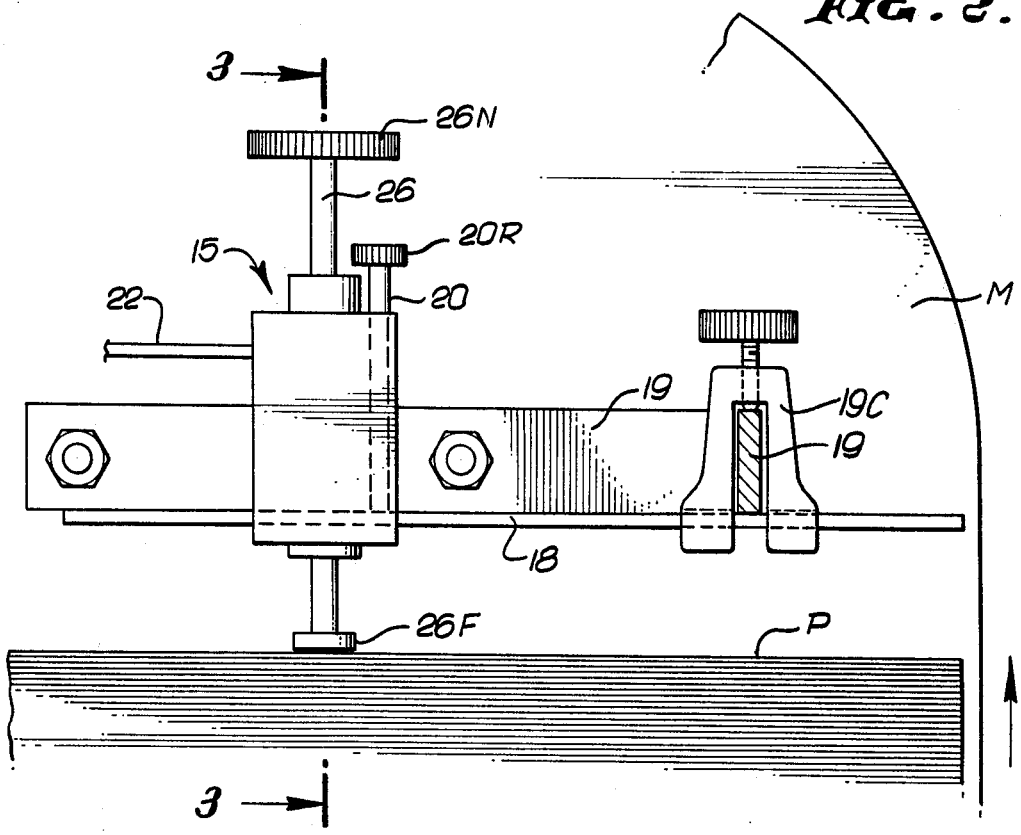
FIG. 2 is a cross-sectional view taken along the line 2—2 of FIG. 1.
Figure 3:
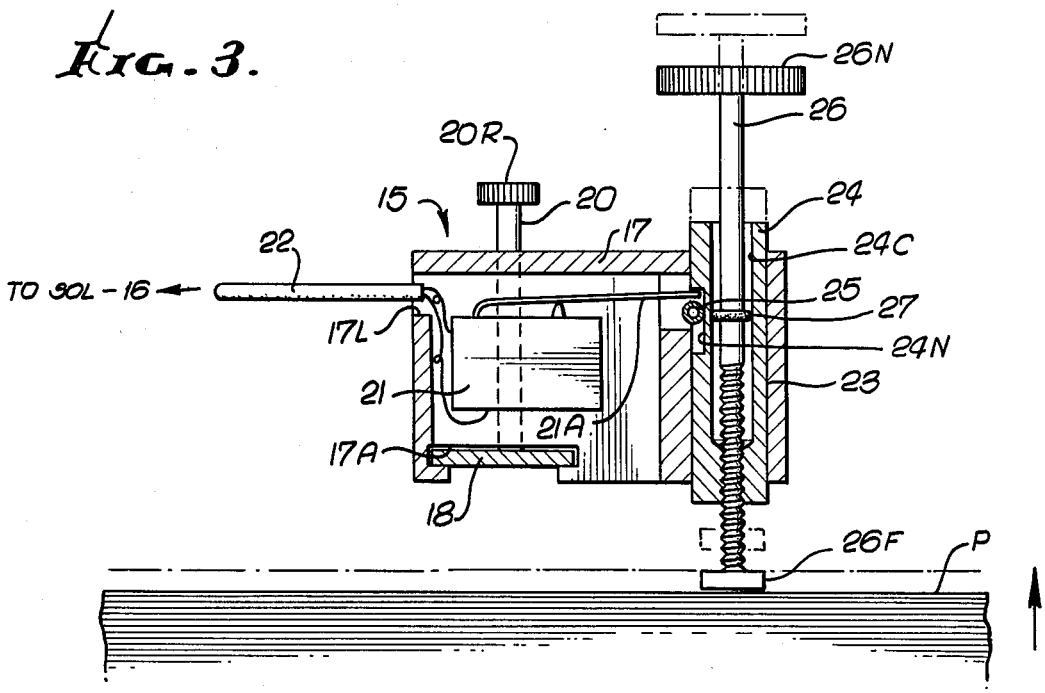
FIG. 3 is a cross-sectional view taken along the line 3—3 of FIG. 2.

The sensing mechanism S comprises a housing 17 having an aperture 17A adjacent the bottom side, as illustrated in the drawings, for permitting it to be slidably received over the end of a mounting bar 18 movably secured to the paper guide 19 for the machine M. The paper guide 19 comprises a U-shaped bracket secured to the opposite sides of the machine M, as best illustrated in FIG. 1. The bar 18 is mounted to the paper guide 19 to be selectively movable between the sides of the machine M to a desired position so as to permit the switch 15 to overlie the stack of paper on the table 10 in the desired position. A paper guide clamp 19C mounts the bar 18 and secures it in the desired lateral position to the paper guide 19. The switch 15 can also be moved longitudinally of the bar 18 and may be secured to the bar in the selected position by means of the threaded fastener 20 extending through the housing 17 to be tightened against the bar 18 for securing it thereto. A round knob 20R is provided for the fastener 20 to facilitate tightening it to the bar 18; see FIGS. 2 and 3.

The housing 17 mounts an electro-mechanical switch 21 adjacent one side thereof. The electro-mechanical switch 21 may be a commercially available microswitch having an operating arm 21A extending outwardly therefrom for operating the electro-mechanical switch between conductive and non-conductive positions. The electro-mechanical switch 21, for the purposes of the present invention, has been selected to have its electrical contacts (not shown) arranged to be normally closed when the arm 21A is free to assume an unrestricted position. The movement of the arm 21A to a vertical position below its normal position will cause the switch to be operated to an open circuit condition. The lead wires 22 for the electrical contacts for the switch 21 are passed through an aperture 17L for the housing 17 and are connected to the solenoid 16. The housing 17 is provided with a longitudinal bore 23 arranged adjacent the switch 21 within the housing 17 for receiving a tubular member 24 mounted therein for sliding movement. The tubular member 24 is provided with a cutout section 24N intermediate its ends for receiving and accommodating the free end of the switch operating arm 21A. A roll pin 25 is provided to extend through the opposite sides of the housing 17 through the cutout 24N and is secured to the housing for preventing the rotation of the tubular member 24. This arrangement also keeps the operating arm 21A from becoming damaged due to any excessive upward or downward pressure exerted on the tubular member 24 by restricting the movement thereof. A central bore 24C is provided for the tubular member 24 which is threaded adjacent its lower end for receiving a correspondingly threaded member 26 that may be adjustably secured thereto. The threaded member 26 is of a length so as to extend out of both ends of the bore 24C and the tubular member 24. The top end of the member 26 mounts an adjustment knob 26N for adjusting the extent that the member 26 extends out of the bottom side of the tubular element 24 for defining a pressure sensing member. The thus defined pressure sensing member 26 may be provided with a flat pressure sensing foot 26F secured to the free end of the member 26. This arrangement permits elements 24 and 26 to move in unison in response to pressure exerted against the pressure sensing foot 26F. The pressure sensing element 26 is also provided with an O-ring 27 mounted thereto for engaging the inner surface of the bore 24C of the tubular element 24. The O-ring 27 is provided with an outside diameter so as to create sufficient friction with the surface of the bore 24C so that the sensing element 26 does not vibrate out of the selected adjustment while the printing machine M is in operation. With this construction, the pressure sensing foot 26F is mounted to engage the top sheet of the stack of paper P, so that a slight upward pressure exerted against the foot 26F will cause the tubular element 24 to move upwardly and remove the restraint on the operating arm 21A for the switch 21 to cause it to switch to its closed circuit condition. The sensing element 26 will continue its upward travel in response to the exerted pressure after the arm 21A has been actuated and may travel upwardly until the roll pin 25 is engaged.

It should also be noted that the tubular element 24 and the sensing element 26 are constructed and defined to have sufficient weight to move the operating arm 21A to an open circuit condition when the switch 15 is arranged in a vertical position without any pressure being exerted against the foot 26F. Since this weight never varies, the adjustment of the sensing element 26 is maintained once it is fixed by securing the sensing element 26 to the tubular element 24. The pressure required for activating the operating arm 21A is so slight that even highly compressible paper stock, such as envelopes, onionskin or the like, can be sensed without causing an "overfeed".

Figure 4:
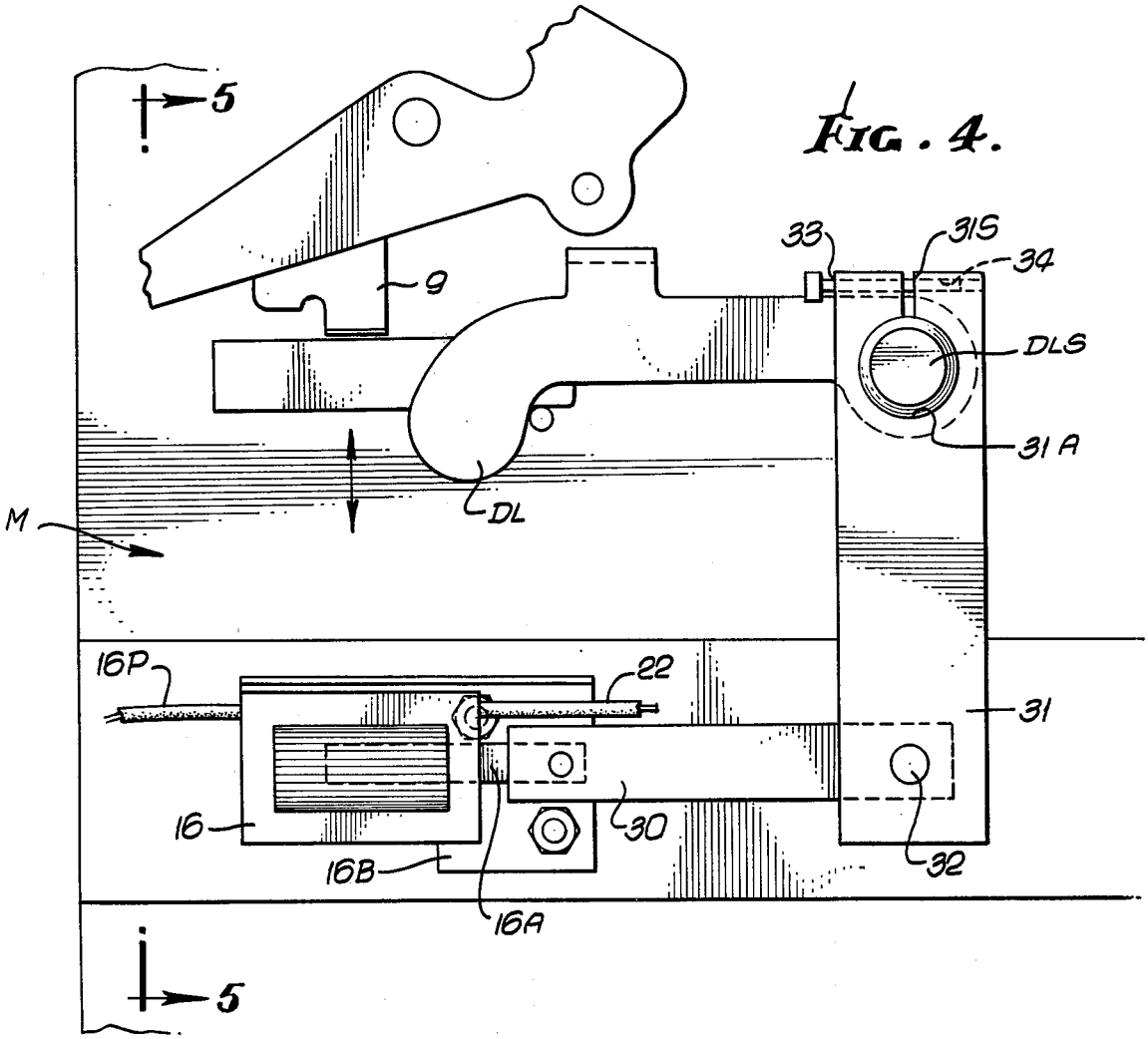
FIG. 4 is a partial, elevational view illustrating the arrangement of the electro-mechanical actuator of the sensing mechanism mounted for actuating the conventional linkage of the printing machine.

The electro-mechanical element or solenoid 16 is energized and de-energized in accordance with the conductive condition of the switch 15 by being connected thereto in series circuit relationship; see FIG. 7. The electro-mechanical element 16 may comprise a commercially available solenoid having a movable actuator 16A coupled thereto. One end of the solenoid actuator 16A is secured to an actuator connecting arm 30 with its opposite end being swingably coupled to a lever actuating arm 31. The lever actuating arm 31 may be coupled to the connecting arm 30 by means of a fastener 32 adjacent one end thereof as illustrated in FIG. 4. The other end of the lever actuating arm 31 is provided with an aperture 31A arranged in communication with a slot 31S to permit it to be slipped over a stub shaft DLS normally provided at one end of the double linkage assembly DL. The lever actuating arm 31 may be secured to the stub shaft DLS by means of a fastener 33 secured to a threaded opening 34 provided adjacent the free end of the actuating arm 31. The energization of the solenoid 16 causes the rotation of the shaft DLS thereby causing the double linkage assembly DL to be elevated for arresting the elevation of the table 10. When the solenoid actuator 16A is properly coupled by means of elements 30 and 31 to the stub shaft DLS it should move through a distance of approximately $\frac{3}{8}''$ to $\frac{1}{2}''$ when activated and will return automatically to its normal position when the electro-mechanical element 16 is de-energized due to the spring tension normally built into the linkage assembly DL.

As will be appreciated from examining the schematic diagram of FIG. 7, the switch 15 and the electro-mechanical element 16 are arranged in a series circuit relationship with the power source. The electrical coil for the solenoid 16 is connected by a power cord 16P to a conventional plug 35. The plug 35 may be connected to a three-way interconnecting plug 36 for coupling to the normal power circuit of the machine M. With reference to FIG. 6, the interconnecting plug 35 is shown coupled to the three-way plug 36 arranged intermediate the conventional male plug 37 and female plug 38 connected thereto and electrically connected to the motor for the machine M. In this fashion, the sensing mechanism S is powered.

With the above structure in mind, the operation of the sensing mechanism S for preventing the overfeeding problems of the prior art printing machine M will now be described. It will be assumed that the sensing element 26 has been adjusted relative to the top sheet of the stack of paper P on the table 10 for sensing when the top of the stack reaches a certain elevation. For this purpose the sensing element 26 will have been adjusted to maintain the switch operating arm 21A in a depressed condition so as to cause the switch 21 to be in an open circuit condition as illustrated in FIG. 7 in preparation for the table elevation operation. With the printing machine M is operation, each sheet of paper will be fed from the top of the stack of paper P into the machine sheet by sheet. The paper height regulator will move lower and lower as each sheet of paper is fed off the top of the stack. At the time that the machine senses that the table 10 should be elevated, the table is automatically actuated so as to raise the level of the top of the stack of paper on the table 10. As the stack of paper 10 is being elevated, it will engage the bottom of the sensing foot 26F. When there is sufficient pressure exerted against the foot 26F by the top sheet of paper the sensing element 26 will be moved vertically upwardly so as to cause it to remove the restraint from the switch operating arm 21A and allow it to move upwardly for operating the switch 21. The operation of the switch 21 places it in a closed electrical circuit condition that causes the solenoid 16 to become energized. The energization of the solenoid 16 will cause the actuator 16A to be pulled in to the left as viewed in FIG. 4, so as to elevate the double linkage DL through the actuation of the linkages 30 and 31 thereby causing the elevation of the table 10 to be arrested. In this fashion, then, the table will be stopped prior to the position it would normally stop, which causes the overfeeding problem in such printing machines. The machine will then be in condition to print and feed the paper sheet by sheet from the top of the stack. As the paper sheets are fed from the top of the stack, the sensing element 26 will slowly move downward in response to the removal of the pressure from the pressure foot 26F and will finally assume its original condition wherein the operating arm 21A again maintains the switch 21 in an open circuit condition. When this condition prevails, the solenoid 16 will again be de-energized but the machine will continue to operate in its normal fashion by feeding the paper from the stack into the machine until the machine senses when the level of the paper has reached an elevation that requires that the table 10 once again be elevated. The sensing of this condition causes the automatic actuation of the mechanism for elevating the table 10.

The sensing mechanism S of the present invention merely senses the upper elevation of the stack of paper P on the table 10 to stop the elevation of the table at the desired point so as not to cause a paper feeding problem. Although the invention is particularly useful with respect to compressible papers that cause the normal operation of the machine to produce the overfeeding problem, the sensing mechanism S can be utilized for better controlling the elevation of the table 10 when noncompressible papers are to be printed. In the event it is desired not to utilize the sensing mechanism S, it can easily be moved out of position with the stack of paper on the table 10 so that the machine can be operated without intervention of the sensing mechanism S.

What is claimed is:

1. A sensing mechanism adapted to be connected to a printing machine for sensing the level of paper to be printed stored on a movable feed table for sensing and automatically regulating the feed level of the paper on the feed table, the machine including actuable means for automatically stopping the elevation of the feed table, said mechanism comprising a housing, an electro-mechanical switch having an operating arm extending outwardly therefrom mounted in the housing for operating the switch between an electrical conductive and non-conductive condition, the operating arm being defined to be sensitive to a slight pressure exerted thereon for operating the switch, a tubular member mounted in the housing for restricted sliding movement in the housing, without rotary movement, and adapted to engage the switch operating arm for moving the arm between a switch open and closed position and vice versa, the internal bore of the tubular member being threaded, a weighted threaded member adapted to be threaded to the tubular member and threaded therein to extend out the opposite end for defining a pressure sensing member responsive to pressure exerted thereon for moving the tubular member for actuating the switch operating arm, the weight of the switch actuating member and the sensing member being selected for normally maintaining the tubular member in a preselected vertical position for normally maintaining the switch in an open circuit condition and movable to a closed circuit condition upon the application of pressure to the pressure sensing member and movable back to the open circuit condition upon the removal of the pressure from the sensing member, and electro-mechanical means connected in electrical circuit with the electro-mechanical switch to be energized and de-energized therethrough, said electro-mechanical means being adapted to be coupled to said actuable means for automatically stopping the elevation of the feed table for actuating same, the engagement of the sensing member with the top of the paper on the rising feed table causes the sensing member to operate the switch to a closed circuit condition whereby the electro-mechanical means actuates said actuable means for automatically arresting the elevation of the paper feed table.

2. A sensing mechanism as defined in claim 1 wherein the electro-mechanical means comprises solenoid means.

3. A sensing mechanism as defined in claim 1 wherein said weighted threaded member carries means for preventing its position in the tubular member from being unintentionally changed.

4. A sensing mechanism as defined in claim 3 wherein said means comprises an O-ring mounted on the threaded member adjacent the inner end of the threads for engagement with the adjacent inner wall of the tubular member when the threaded member is secured in a sensing position.

5. A sensing mechanism as defined in claim 4 wherein the tubular member is provided with a threaded bore at the sensing end thereof, the weighted threaded member having a sensing foot with an enlarged sensing area larger than the diameter of the weighted threaded member secured to said threaded bore.

* * * * *

UNITED STATES PATENT OFFICE

CERTIFICATE OF CORRECTION

Patent No. 4,206,912 Dated June 10, 1980

Inventor(s) Rune S. Pearson

It is certified that error appears in the above-identified patent and that said Letters Patent are hereby corrected as shown below:

Column 1, line 39, change the word "machine" to -- mechanism --.

Column 3, line 27, before the word "paper" add the word -- proper --.

Column 4, line 10, change numeral "6" to -- 16 --.

Signed and Sealed this

*Thirteenth* Day of *January 1981*

[SEAL]

*Attest:*

SIDNEY A. DIAMOND

*Attesting Officer*

*Commissioner of Patents and Trademarks*